US005229539A

United States Patent [19]

Rommel

[11] Patent Number: 5,229,539

[45] Date of Patent: Jul. 20, 1993

[54] FIRING PIN ARRANGEMENT IN A FIREARM

[75] Inventor: Emil Rommel, Dornhan, Fed. Rep. of Germany

[73] Assignee: Heckler & Koch GmbH, Oberndort, Fed. Rep. of Germany

[21] Appl. No.: 19,449

[22] Filed: Feb. 10, 1987

[30] Foreign Application Priority Data

Mar. 12, 1986 [DE] Fed. Rep. of Germany ..... 3608260

[51] Int. Cl.[5] ..... F41A 19/13

[52] U.S. Cl. ..... 89/27.14; 42/69.01

[58] Field of Search ..... 89/26, 27.14, 132; 42/69.02, 69.03, 70.08, 69.01

[56] References Cited

U.S. PATENT DOCUMENTS

| | | | |
|---|---|---|---|
| 466,320 | 1/1892 | Benet | 89/26 |
| 530,966 | 12/1894 | Seymour | 42/16 |
| 985,171 | 2/1911 | Hermsdorf | 89/27.14 |
| 2,539,644 | 1/1951 | Turner | 42/69.03 |
| 3,563,132 | 2/1971 | Cashen et al. | 89/132 |
| 3,721,032 | 3/1973 | Shum, Jr. et al. | 89/26 |
| 4,263,836 | 4/1981 | Koine | 89/26 |
| 4,644,845 | 2/1987 | Garehime, Jr. | 89/41.05 |

FOREIGN PATENT DOCUMENTS

| | | | |
|---|---|---|---|
| 2405763 | 8/1975 | Fed. Rep. of Germany | 89/26 |
| 230870 | 10/1925 | United Kingdom | 89/26 |

*Primary Examiner*—Stephen M. Johnson
*Attorney, Agent, or Firm*—Pollock, VandeSande and Priddy

[57] ABSTRACT

A firing pin arrangement for a firearm using caseless ammunition wherein the firing pin is activated by rotary movement and a protrusion on the firing pin that is eccentrically displaced relative to an axis of the firing pin is used for setting off the aforementioned caseless ammunition.

5 Claims, 5 Drawing Sheets

FIRING PIN ARRANGEMENT IN A FIREARM

DESCRIPTION

This invention refers to a firing pin arrangement in a firearm.

In conventional firearms a firing pin that is movable along its longitudinal axis strikes the primer of a cartridge with its firing pin tip which is guided by the bolt face of the bolt head. The ignition and the combustion of the propellant take place in the cartridge case and during the acceleration of the projectile in the barrel, in which phase the gas forces counteract particularly via the cartridge base on the breech face of the bolt head.

However, in firearms firing caseless ammunition, the propulsive gas forces also act upon the frontal areas of the firing pin tip and the firing pin facing the chamber. During this phase propulsive gases escape along the firing pin into the weapon housing. This propulsive gas leakage not only causes a loss of propulsive gas pressure needed for driving the projectile along the barrel bore, but it also creates a further disadvantage resulting from the fact that these propulsive gases carry along solid particles causing erosion on operational and structural parts. Moreover, there is an overpressure build-up inside the weapon housing.

With the firing pin arrangement of the present invention, the firing pin features a cone shaped supporting shoulder at its side not facing the chamber, which contacts a likewise cone shaped contact surface in the firing pin bearing bore when the cartridge is ignited and the firing pin is driven back under the action of the generating propulsive gases. Gas sealing is only effective at the moment when the supporting shoulder contacts the contact surface, thus preventing the propulsive gases from escaping into the weapon housing.

However, experience has revealed that even a small number of ignitions demolish the supporting shoulder and the contact surface, resulting in an inefficient gas sealing. This demolision is caused by the forces and velocities occurring during the rearward stroke of the firing pin, being so violent that they destroy the sealing surfaces.

There is a requirement for improving said firing pin arrangement in a way that it prevents the escape of propulsive gases out of the borehole where the firing pin is movably mounted, when igniting caseless cartridges.

The solution to these problems has been realized by the fact that the firing pin is located in a cavity which is only open on the side adjacent to the chamber and housing of which has a bore that serves as bearing for the firing pin shaft. The sealing between the firing pin shaft which carries out a rotary movement and the bore is designed as a shaft packing. Thus, an eventual escape of propulsive gas would only be possible between bore and firing pin shaft. This gas escape at the rotary firing pin shaft is effectively prevented by the shaft packing.

In the ensuing applications the shaft packing features a blunt cone-shaped supporting shoulder at the bore whereby the shoulder widens towards the chamber, and a firing pin shaft contact surface that fits the supporting shoulder.

Instead of this arrangement, where the propulsive gases press the firing pin shaft contact surface against the supporting shoulder there also exists the possibility for other kinds of shaft packings between the firing pin shaft and the bore.

One may, for example, arrange packing disks between bore and firing pin shaft.

In the following examples of applications of the invention are explained in detail by means of the following drawings.

Figure 1:
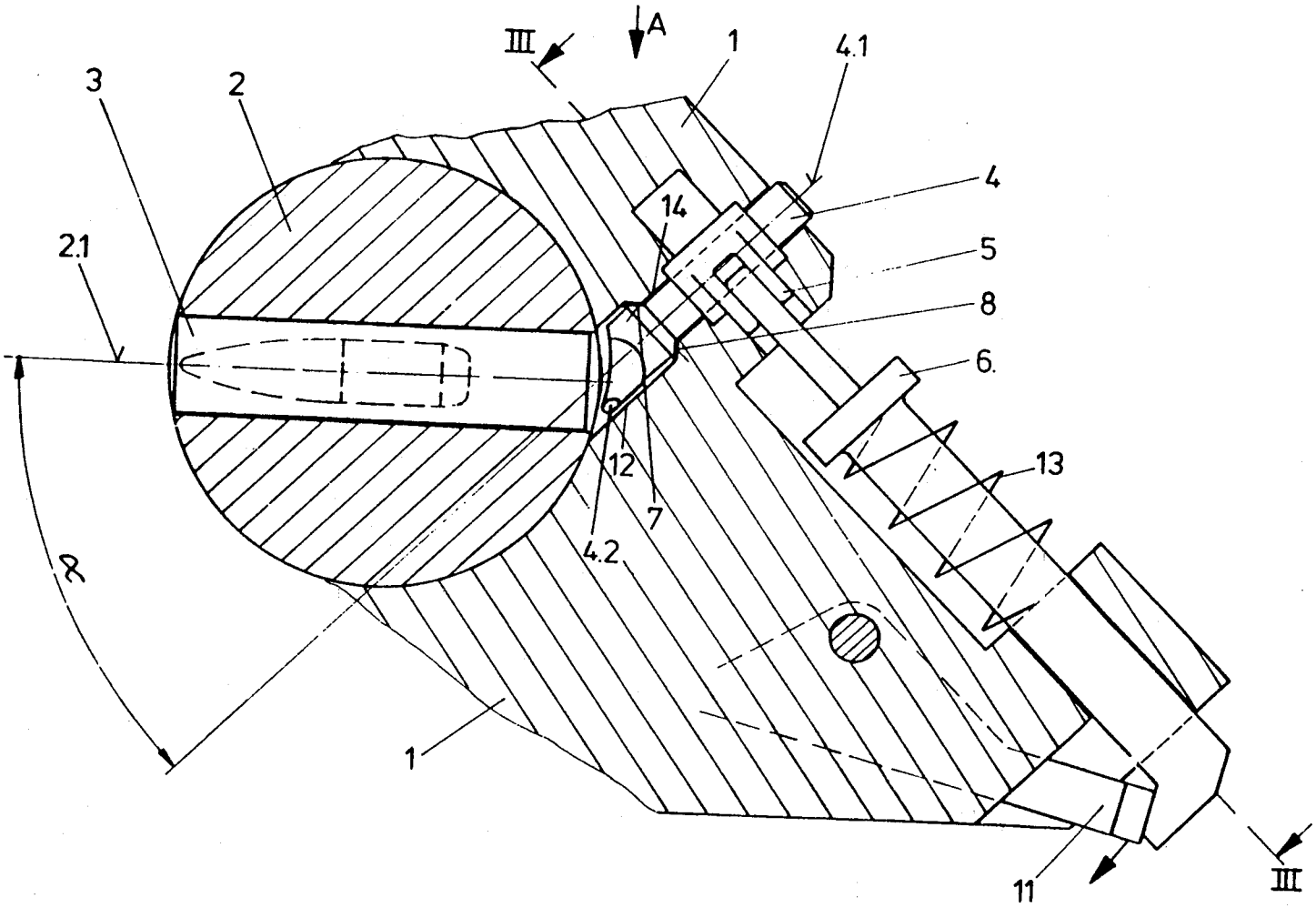
FIG. 1 is a sectional drawing of the part of the weapon which supports the firing pin with the cylinder breech, where the drive of the firing pin shaft is carried out via a crank gear and where the firing pin is shown in its rest position.
Figure 2:
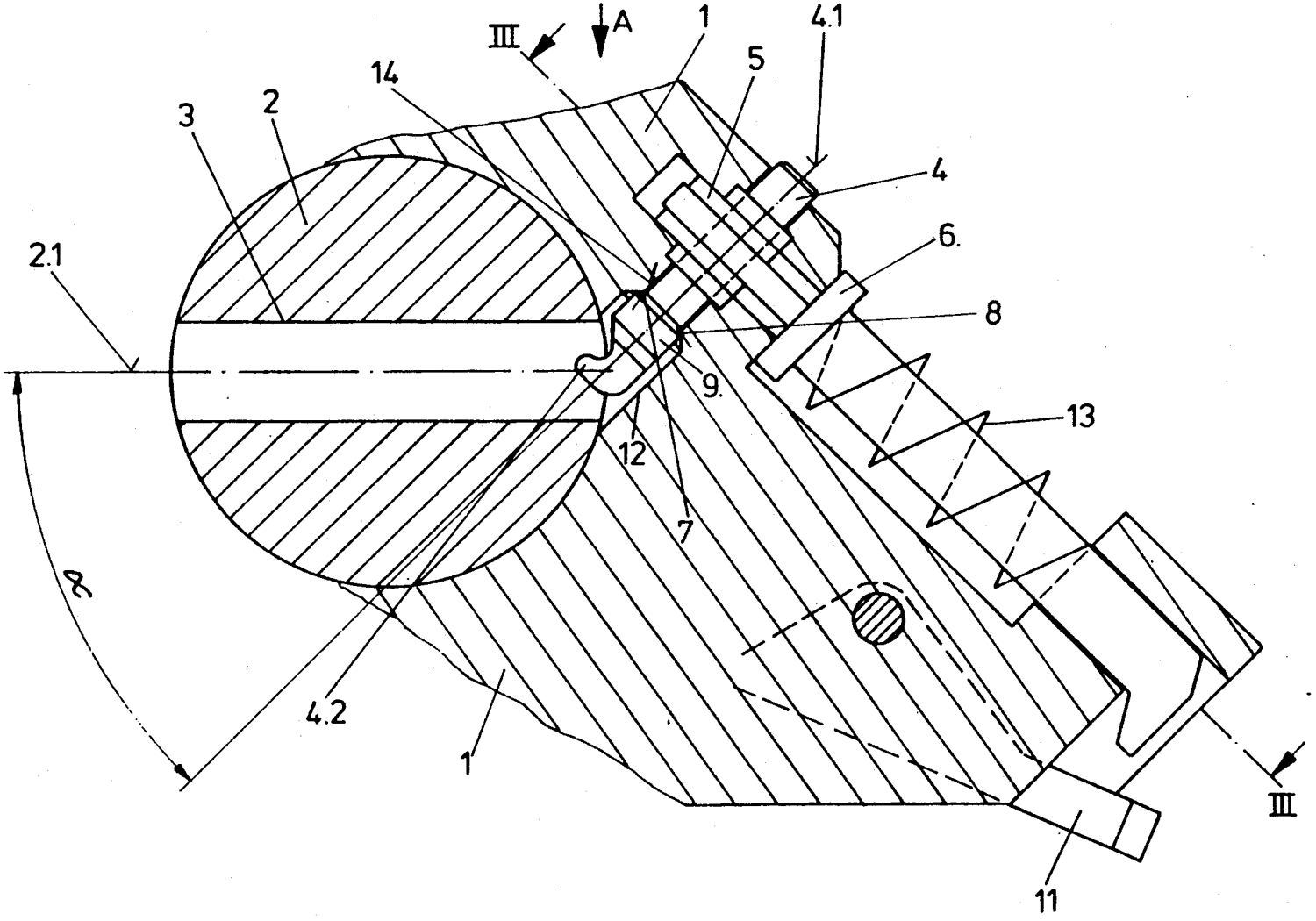
FIG. 2 is a sectional drawing according to FIG. 1 where the firing pin is in its igniting position.

The sectional drawing according to FIG. 1 and 2 proceeds vertical to the axis of cylinder breech 2, where the chamber 3 is arranged, the axis of which in its firing position is in alignment with the bore axis 2.1 of the weapon. The weapon part 1 which supports the cylinder breech 2 houses a cavity 12 which is open on the side adjacent to the chamber 3 and which has a cylindrical configuration and in which ends a bore 14. Firing pin 9, being arranged in cavity 12, is a one-piece unit with firing pin shaft 4 which is pivotally supported in bore 14. The rotary axis 4.1 of the firing pin 4, being the axis of bore 14 proceeds acutely-angled under the angle $\alpha$ to the barrel bore axis 2.1 of the weapon. The striking portion 9 of the firing pin consists of a protrusion 4.2. For forming this protrusion 4.2 the initially cylindrical firing pin 9 is inclined in the direction of protrusion 4.2.

The bore 14 features a cone shaped supporting shoulder 8 which widens in the direction of cavity 12. The interface between firing pin 9 and firing pin shaft 4 is designed as a contact surface 7 which also has a blunt cone shape fitting the supporting shoulder 8.

A crank 5 is rigidly connected to firing pin shaft 4, where this crank is pivotally fixed to crank lever 6. A firing pin spring 13 is arranged between crank lever 6 and weapon part 1. In FIG. 1 this firing pin spring 13 is shown in its cocked position. A pivotally mounted sear lever 11 on weapon part 1 holds crank lever 6 in position against the pressure of spring 13, as shown in FIG. 1.

FIG. 1 represents a condition where the firing pin protrusion 4.2 which is arranged eccentrically to the rotary axis 4.1 is completely contained inside cavity 12. The rotary axis 4.1 always stays in a position $\alpha$ to the axis of the barrel bore 2.1 and proceeds, congruent or parallel to bore axis 2.1, looking in direction of arrow A. The inclination of the firing pin 9, by means of which the protrusion 4.2 is formed, proceeds in a plane vertical to the bore axis 2.1, shown by the position of the firing pin 9 in FIG. 1.

Figure 3:
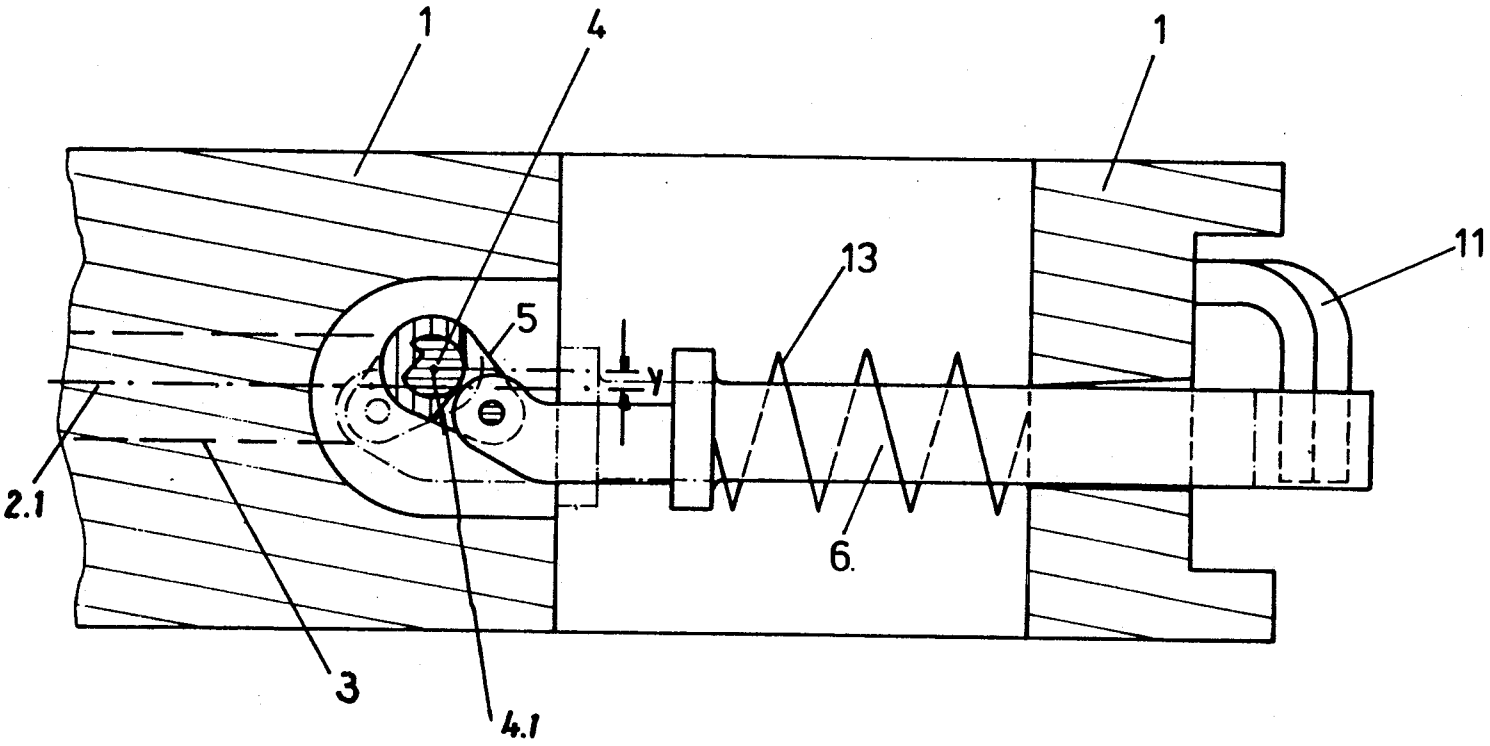
FIG. 3 is a sectional drawing along line III—III in the FIGS. 1 and 2.

When the sear lever 11 is pivoted clockwise, the spring 13 pushes the crank lever into the position marked by the dotted line in FIG. 3, in which the crank lever 6 pivots the crank 5, so that the firing pin shaft 4 rotates together with the firing pin 9.

As a result of this rotary movement the eccentric protrusion 4.2 pivots into the area of the chamber 3 where it strikes the primer at the base of the cartridge. This action initiates the ignition of the cartridge in the chamber 3. The propulsive gases expanding from the chamber 3 thereby act upon the firing pin 9 and thus push the contact surface 7 against the supporting shoulder 8. The propulsive gas forces acting in the direction of the firing pin axis 4.1 press the firing pin 9 with approx. 4,000 atmospheres pressure (bar) against the supporting shoulder 8. This action produces an efficient gas seal, which means that no gas can escape between bore 14 and firing pin shaft 4 out of cavity 12.

When the ignition is terminated the firing pin 9 with the firing pin shaft 4 is returned by means of the crank 5 from the position shown in FIG. 2 to the position shown in FIG. 1, whereby the firing pin spring 13 is cocked and the crank lever 6 is locked by the sear lever 11.

The rotary movement of the firing pin 9 from its rest position to its actuating or igniting position, respectively and back again can be coupled in a form-locking way to the rotation of the cylinder breech 2, by means of which simultaneous rotary movements of cylinder breech 2 and firing pin 9 are possible.

This characteristic makes it possible to achieve the highest possible rate of fire in the firing sequence. This coupling of motions moreover eliminates the need for additional operational parts required for setting back the firing pin 9 in case of misfires.

In the arrangement described here the firing pin 9 transmits the ignition energy exclusively by a rotary movement around its longitudinal axis 4.1.

Figure 4:
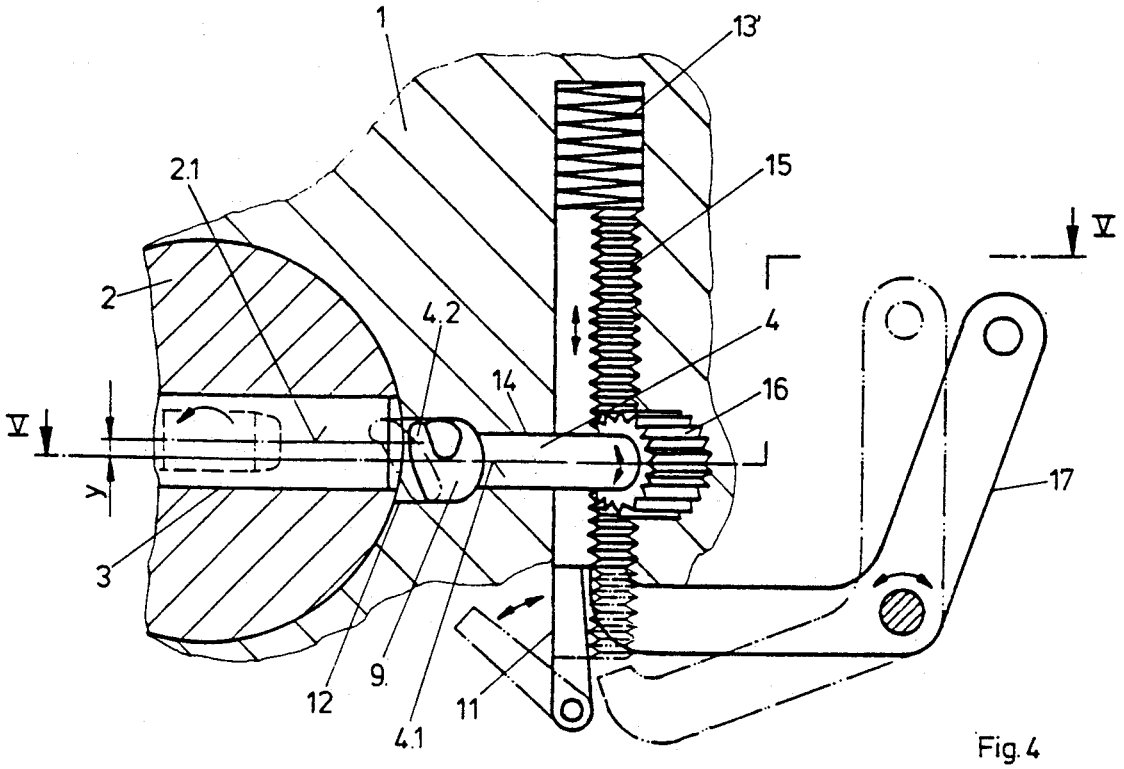
FIG. 4 is a sectional drawing according to FIGS. 1 and 2 with an arrangement where the firing pin shaft is driven by a toothed-wheel gearing.
Figure 5:
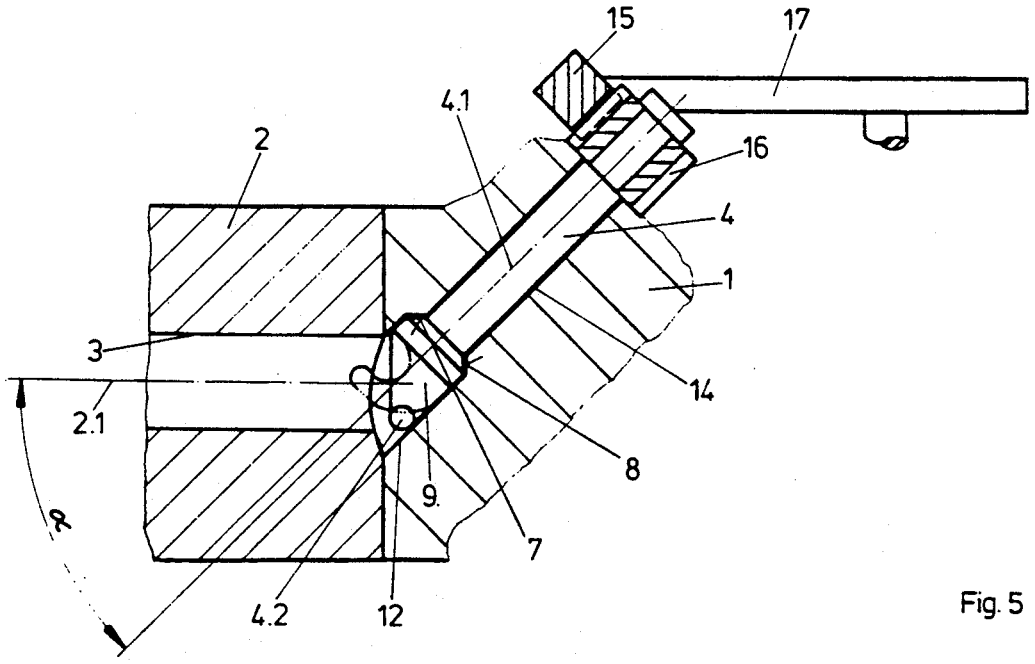
FIG. 5 is a sectional drawing along line V—V in FIG. 4.

In the arrangement according to FIGS. 4 and 5 the axis 4.1 proceeds vertical to the position represented in FIG. 1 and 2; however, it is also positioned at an acute angle $\alpha$, to the bore axis 2.1. As already mentioned referring to FIG. 1, the axes 2.1 and 4.1 may be congruent, viewing in the direction of the arrow A, forming a common plane.

In the arrangements of FIGS. 1-5, the axes 2.1 and 4.1 may be displaced in a staggered way by an amount Y (see FIG. 3) which is identical or smaller than the eccentricity between the protrusion 4.2 and the rotary axis 4.1. This approximately corresponds to the radius of the firing pin head 9, having a circular cylindrical shape. This parallel displacement makes sure that the protrusion 4.2 strikes the center fire cartridges inside the chamber 3 in the center of the primer.

According to FIGS. 4 and 5 the rotary movement of the firing pin shaft 4 and of the firing pin 9 is effected by a toothed-wheel gearing. The part of the firing pin shaft 4 not facing the cavity 12 is provided with a rigidly fixed pinion 16 which is in engagement with the toothed rack 15. The toothed rack 15 is acted upon by the firing pin spring 13, being arranged between the toothed rack 15 and the weapon part 1. The sear lever 11 holds the toothed rack 15 with the firing pin 9 in their rest position. Pivoting the sear lever 11 counter-clockwise transforms the longitudinal travel of the toothed rack 15 which has been effected by the firing pin spring 13, into a rotary motion of the firing pin 9, whereby the protrusion 4.2 of the firing pin 9 penetrates into the area of the chamber 3. In FIG. 4 and 5 dotted lines mark the final positions.

The firing pin 9 is pivoted to its rest position by a cocking lever 17 which acts upon the toothed rack 15 whereby the firing pin spring 13 is cocked. In the cocked position the sear lever 11 is swivelled clockwise towards the toothed rack 15.

For the rest of the arrangement this design corresponds to the example according to FIGS. 4 and 5 and to the example of FIG. 1 through FIG. 3.

Figure 6:
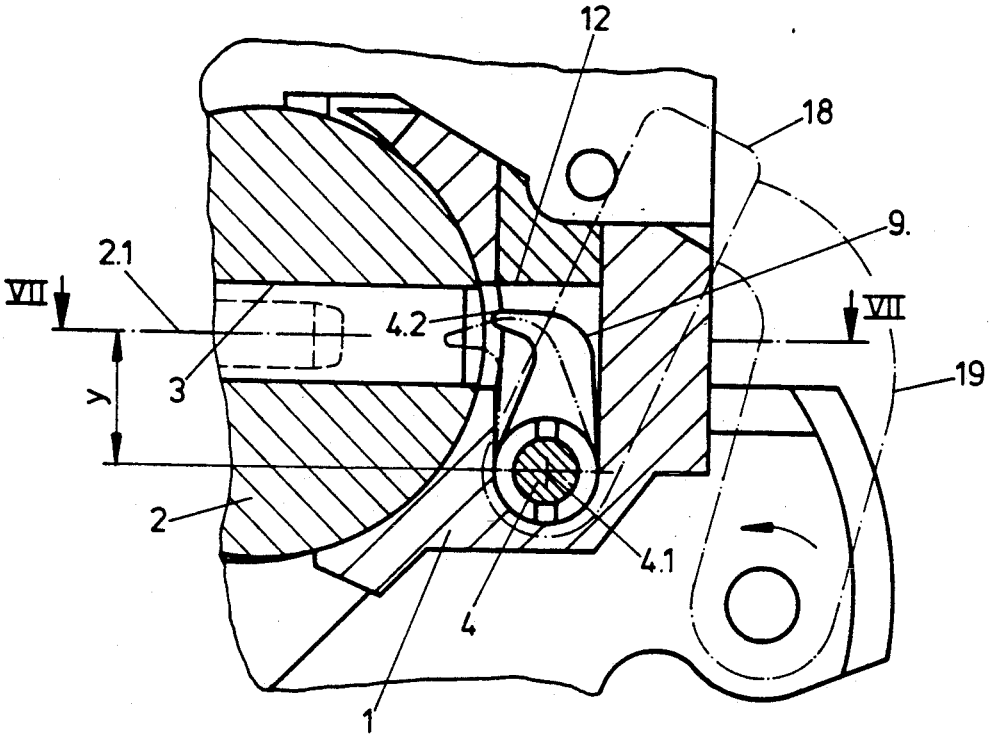
FIG. 6 is a sectional drawing according to FIGS. 1 and 2 with an additional example of application.
Figure 7:
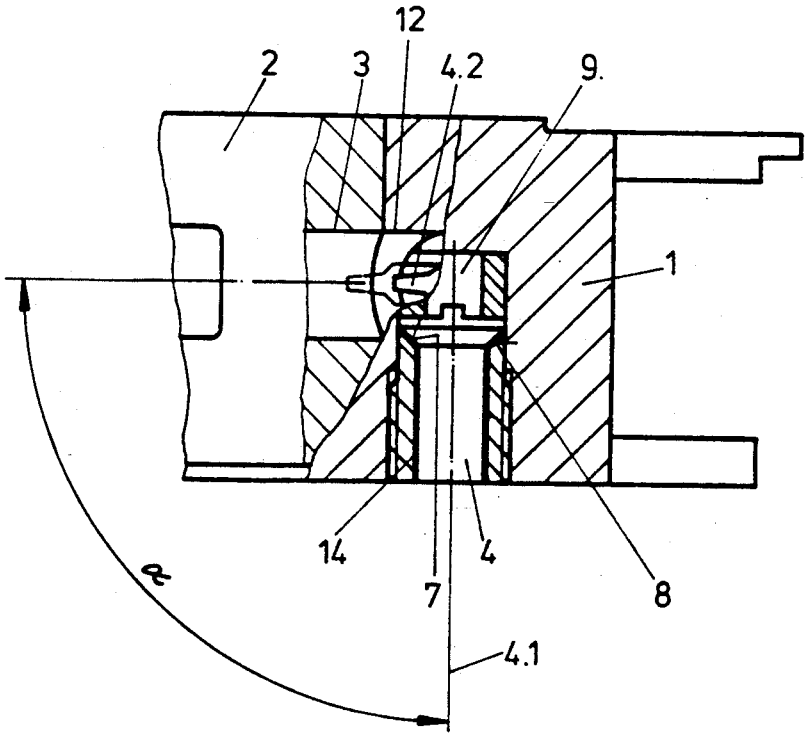
FIG. 7 is a sectional drawing along line VII—VII in FIG. 6.

In the arrangement of FIGS. 6 and 7 the axis 4.1 of the firing pin shaft proceeds vertical to the bore axis 2.1. In this application the angle $\alpha$ also is a 90° angle. The end of the firing pin shaft 4 projecting into the cavity 12 holds the firing pin 9 which is hook-shaped and therefore pivotable in a plane vertical to the rotary axis 4.1 of the firing pin shaft 4. The axis 4.1 is displaced to the bore axis 2.1 for the distance Y, whereby this displacement Y approximately corresponds to the distance between the rotary axis 4.1 and the protrusion 4.2.

In its rest position the protrusion 4.2 is located inside the cavity 12. Turning the firing pin shaft 4 counter-clockwise swivels this protrusion 4.2 into the chamber 3.

This swivelling movement can be carried out by means of a crank drive or a toothed-wheel gearing, as already explained in the preceding applications. In the arrangement shown here a lever 18 is connected to the firing pin shaft 4, acting upon a striking element 19 which corresponds to a hammer.

The design of the sealing means between the supporting shoulder 8 and the contact surface 7 is the same as already described in the preceding applications.

I claim:

1. A firing pin arrangement in a firearm, particularly in an automatic small firearm for ignition of caseless ammunition, comprising a chamber for said caseless ammunition located along a barrel bore axis, a firing pin having a protrusion which acts as a striking portion for initiating ignition of said caseless ammunition, a cavity in said firearm in which said firing pin is located, said cavity being open to said chamber, a bore in said firearm which ends in said cavity, and a firing pin shaft which is supported by said bore in a gas-tight and axially fixed manner for rotary movement around the axis of said bore, said firing pin and said firing pin shaft being rigidly connected to one another, said protrusion being eccentric to the axis of said bore, and the axis of said bore being oriented at an acute angle to said barrel bore axis, whereby in a first rotary position of said firing pin said protrusion is within said cavity and in a second rotary position of said firing pin said protrusion is located within said chamber.

2. A firing pin arrangement according to claim 1 wherein the extended axis of said bore is disposed in staggered relation to the extended axis of said barrel bore, the extended axis of said bore being displaced from the extended barrel bore axis by a distance that is at most equal to the amount by which said protrusion is eccentric to said axis of said bore.

3. A firing pin arrangement according to claim 1 wherein said firing pin and said firing pin shaft are provided as a one-piece unit.

4. A firing pin arrangement according to claim 1 wherein said rotary movement of said firing pin shaft is effected by a crank gear connected to said firing pin shaft.

5. A firing pin arrangement according to claim 4 wherein a crank is rigidly connected to said firing pin shaft, said crank being pivotally fixed to a crank lever on which a firing pin spring acts.

* * * * *